US005594957A

United States Patent [19]

Shih

[11] Patent Number: 5,594,957

[45] Date of Patent: Jan. 21, 1997

[54] FOLDABLE TOILET SEAT COVER

[76] Inventor: Shiu F. Shih, 7F-1, No. 303, Chong Ming South Road, Taichung, Taiwan

[21] Appl. No.: 665,676

[22] Filed: Jun. 20, 1996

[51] Int. Cl.[6] ..... A47K 13/10

[52] U.S. Cl. ..... 4/242.1; 4/234; 4/246.1; 4/661; 220/332; 220/212.5

[58] Field of Search ..... 4/242.1, 253, 661, 4/234, 233, 238, 246.1, 235, 236; 220/752, 770, 318, 332, 334, 212.5; 297/188.1; 312/324, 213

[56] References Cited

U.S. PATENT DOCUMENTS

| | | | |
|---|---|---|---|
| 1,362,671 | 12/1920 | Budge | 4/242.1 |
| 3,205,510 | 9/1965 | Levine | 4/234 |
| 3,344,441 | 10/1967 | Kelly | 4/233 |
| 3,601,822 | 8/1971 | Weiss | 4/234 |

FOREIGN PATENT DOCUMENTS

| | | | |
|---|---|---|---|
| 1204257 | 1/1960 | France | 4/234 |
| 5-176862 | 7/1993 | Japan | 4/242.1 |
| 5-184481 | 7/1993 | Japan | 4/242.1 |

*Primary Examiner*—Henry J. Recla
*Assistant Examiner*—Charles R. Eloshway
*Attorney, Agent, or Firm*—Charles E. Baxley, Esq.

[57] ABSTRACT

A foldable toilet seat cover includes two sections pivotally coupled together. A lower section has a lower portion for pivotally coupling to a toilet seat. The lower portion of the upper section includes a notch for engaging with a handle. The handle includes a cavity for engaging with the hand of a user and includes two side portions each having a slot for engaging with fastening members so as to allow the handle to be rotated about the fastening members. The lower section includes a rear peripheral flange for engaging with and for retaining newspaper and books.

2 Claims, 3 Drawing Sheets

FOLDABLE TOILET SEAT COVER

BACKGROUND OF THE INVENTION

1. Field of the Invention

The present invention relates to a toilet seat cover, and more particularly to a foldable toilet seat cover.

2. Description of the Prior Art

Typical toilet seat covers comprise an integral configuration that may not be folded and that includes a height slightly greater than that of the toilet tank such that the toilet seat cover may obstruct the fetching of the toilet paper which is disposed above the toilet tank. In addition, normally, the toilet seat cover is not noticed by the user and will not be moved or rotated downward to cover the toilet seat.

The present invention has arisen to mitigate and/or obviate the afore-described disadvantages of the conventional toilet seat covers.

SUMMARY OF THE INVENTION

The primary objective of the present invention is to provide a toilet seat cover which is foldable so as to be prevented from obstructing the fetching of the toilet paper.

In accordance with one aspect of the invention, there is provided a foldable toilet seat cover comprising a first section including a lower portion for pivotally coupling to a toilet seat and including an upper portion, and a second section including a lower portion pivotally coupled to the upper portion of the first section at a pivot pin, the second section including a handle provided therein for operating the toilet seat cover. The first section may be folded relative to the second section so as to be prevented from obstructing the fetching of the toilet paper.

The lower portion of the second section includes a notch formed therein for engaging with the handle therein, the handle includes a cavity formed therein for engaging with a hand of a user and includes two side portions each having a slot formed therein for engaging with fastening members so as to allow the handle to be rotated about the fastening members.

The first section includes a rear portion having a peripheral flange formed thereon for engaging with and for retaining newspaper and books therein.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
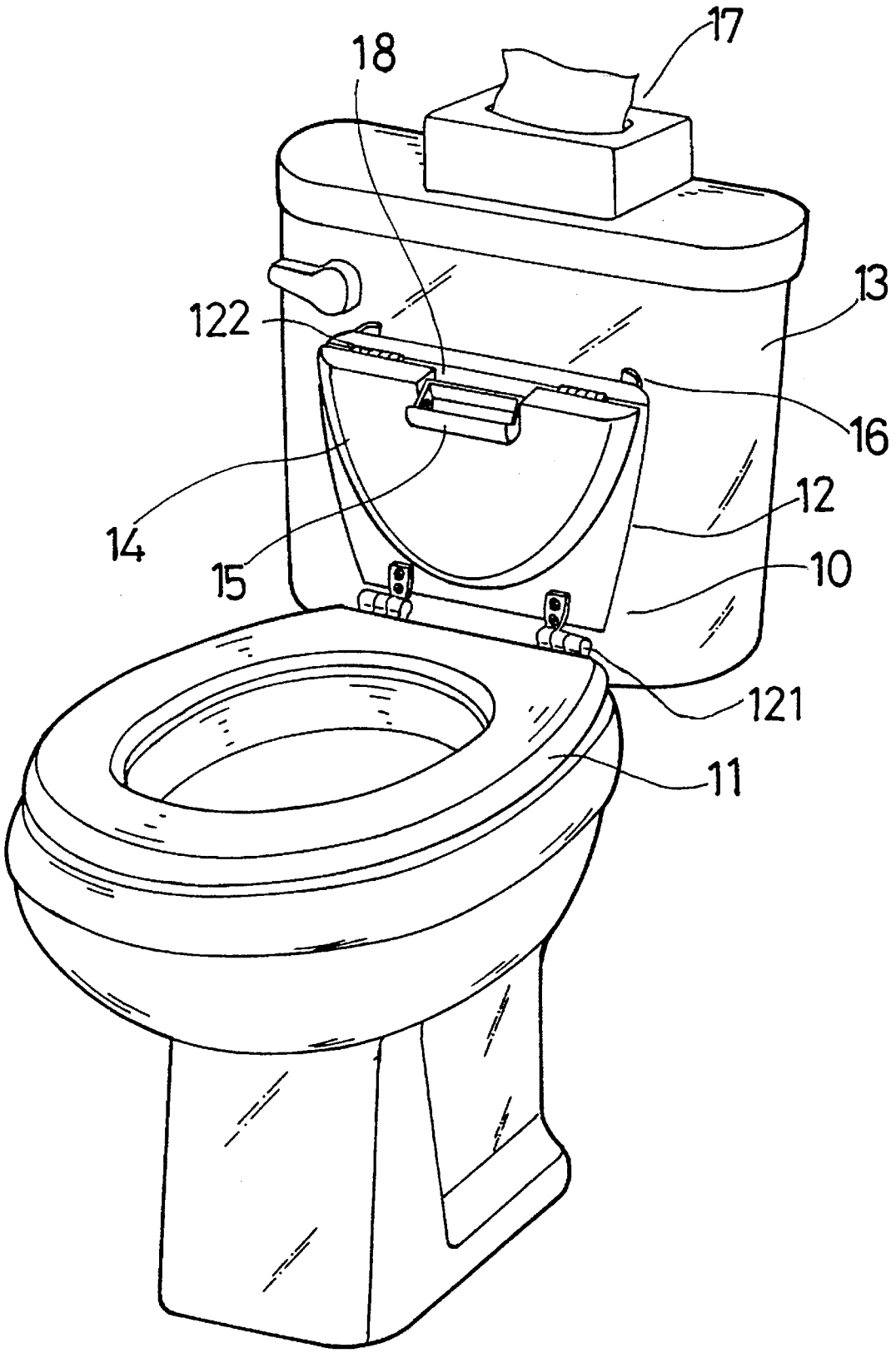
FIGS. 1 and 2 are perspective views illustrating the operation of a foldable toilet seat cover in accordance with the present invention.
Figure 2:
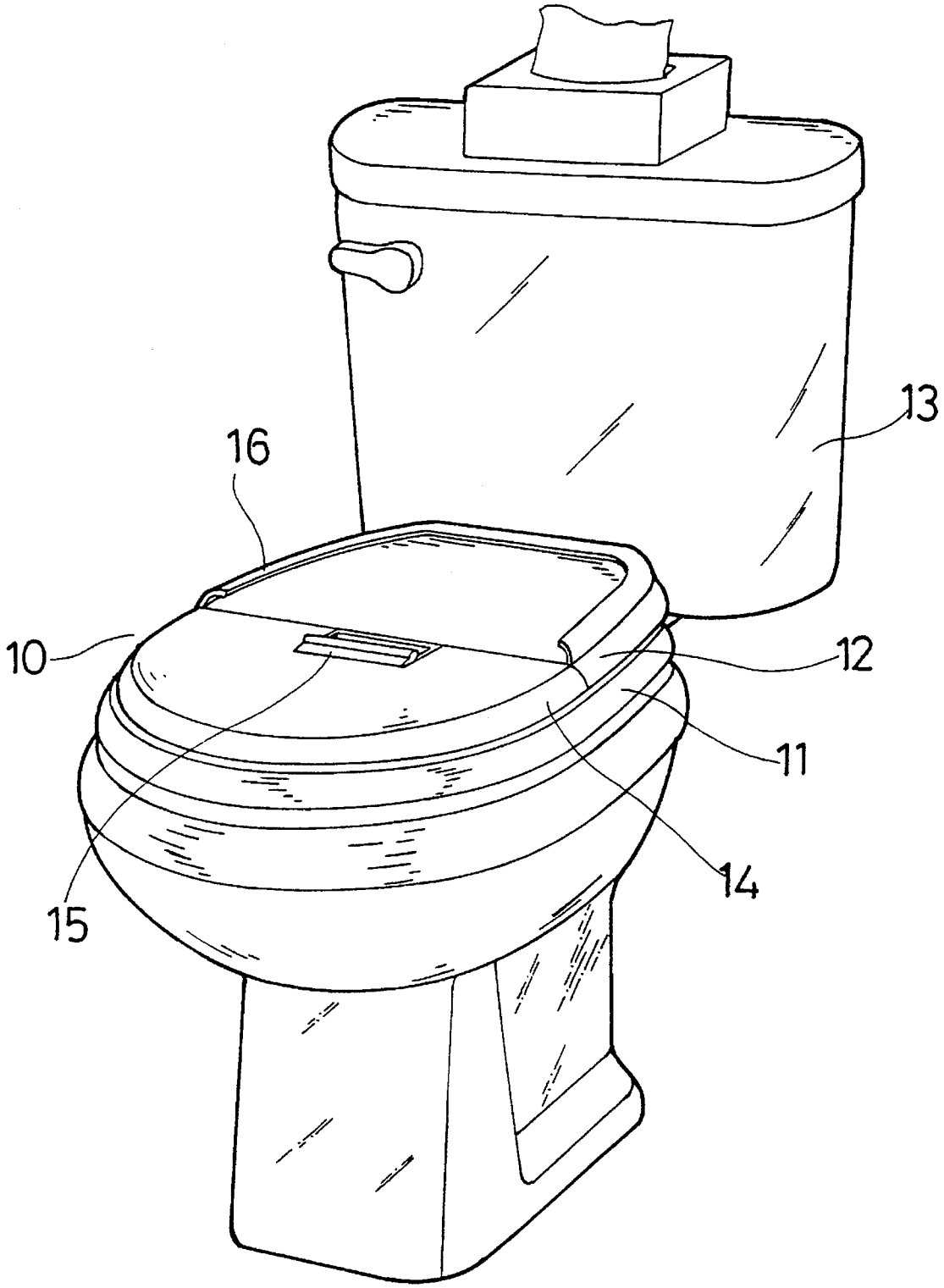
Figure 3:
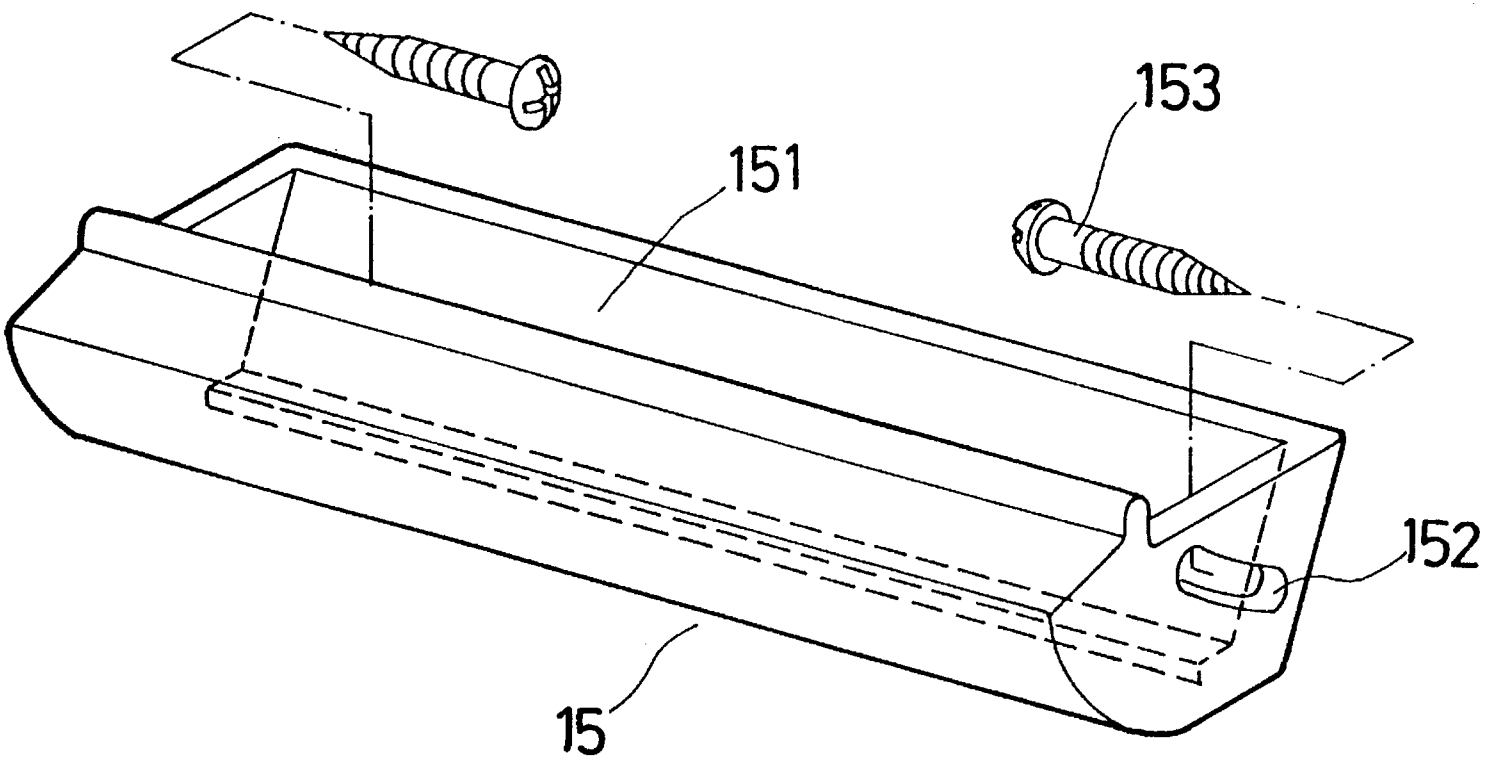
FIG. 3 is a perspective view of the handle for the foldable toilet seat cover.

Referring to the drawings, and initially to FIGS. 1 and 2, a foldable seat cover for a toilet in accordance with the present invention is generally indicated by reference numeral "10" and comprises a first section 12 including a lower portion pivotally coupled to the seat 11 or to the toilet tank 13 at a pivot shaft 121 and including a second section 14 having a lower portion pivotally coupled to the upper portion of the first section 12 at a pivot pin 122. The lower portion of the second section 14 includes a notch 18 formed therein for engaging with a handle 15 therein. As shown in FIG. 3, the handle 15 includes a cavity 151 formed therein for engaging with the hand of the user and includes two side portions each having a slot 152 formed therein for engaging with the fastening screws 153. The handle 15 may rotate relatively about the fastening screws 153 such that the handle 15 may be easily operated when the toilet seat cover is in an upright and folded position (FIG. 1) or in a horizontal and unfolded position (FIG. 2).

As shown in FIGS. 1 and 2, the first section 12 includes a rear portion having a peripheral flange 16 formed thereon for engaging with and for retaining the newspaper or books therein when the seat is placed in the upright position with the first section facing the toilet tank.

In operation, as shown in FIG. 1, when the toilet seat cover is in an upright and folded position, the second section 14 is folded downward such that the second section 14 will not obstruct the toilet paper 17 supported on the toilet tank 13.

Accordingly, the toilet seat cover in accordance with the present invention is foldable so as to be prevented from obstructing the fetching of the toilet paper. In addition, the first section includes a rear portion having a peripheral flange for engaging with and for retaining the newspaper or books therein.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A foldable toilet seat cover comprising:

a first section rotatable between a horizontal position above and parallel to a toilet seat, and a vertical position proximate a toilet tank, said first section, when in said vertical position, having a lower portion adapted to be pivotally coupled to a toilet seat seat hinge axis, an upper portion, and a rear portion which faces said toilet tank, said rear portion having a flange connected thereto and extending rearwardly therefrom along peripheral edges of said first section, said flange being curved so as to hold newspaper and books therein and against said rear portion when said first section is in said vertical position; and, a second section, rotatable between a horizontal position which is coextensive with said first section and a vertical position which is parallel to and adjacent said first section, said second section, when in said vertical position, having an upper portion connected to said upper portion of said first section by a pivot pin, said second section further having a handle therein for folding and unfolding said toilet seat cover.

2. A foldable toilet seat cover according to claim 1, wherein said lower portion of said second section includes a notch formed therein for housing said handle therein, said handle includes a cavity formed therein for engaging with a hand of a user and includes two side portions each having a slot formed therein for engaging with fastening members connected to said notch so as to allow said handle to be rotated about said fastening members.

* * * * *